United States Patent [19]

Riskin

[11] Patent Number: 4,846,594

[45] Date of Patent: Jul. 11, 1989

[54] APPARATUS FOR PRINTING OF ENVELOPES AND PRE-PACKAGED MAILING INSERTS LOCATED THEREIN

[75] Inventor: Bernard N. Riskin, Lambertville, N.J.

[73] Assignee: Fon-Ex Inc., Lambertville, N.J.

[21] Appl. No.: 270,857

[22] Filed: Nov. 14, 1988

[51] Int. Cl.[4] ..... B41J 17/00

[52] U.S. Cl. ..... 400/188; 400/190; 400/174; 282/11.5 A

[58] Field of Search ..... 400/497, 188–190, 400/174–175, 37; 282/11.5 A, 14, 19 R

[56] References Cited

U.S. PATENT DOCUMENTS

| | | | |
|---|---|---|---|
| 1,623,366 | 4/1927 | Strawn | 400/190 |
| 1,653,362 | 12/1927 | Kurowski | 400/206.2 |
| 1,930,605 | 10/1933 | Bomert | 400/190 |
| 2,016,599 | 10/1935 | Graves | 400/190 |
| 2,209,586 | 7/1940 | Swift, Jr. | 400/190 |
| 2,306,616 | 12/1942 | Copeland | 400/190 |
| 2,405,562 | 8/1946 | Ellerbecu | 400/188 |
| 2,858,004 | 10/1958 | Febvre | 400/188 |
| 2,869,704 | 1/1959 | Gates, Jr. | 400/188 |
| 3,104,799 | 9/1963 | Steidinger | 282/11.5 A |
| 3,608,816 | 9/1971 | Neubauer | 282/11.5 A |
| 4,684,270 | 8/1987 | Sakurai | 400/174 |
| 4,692,041 | 9/1987 | Dyma et al. | 400/188 |
| 4,793,724 | 12/1988 | Battles | 400/174 |

FOREIGN PATENT DOCUMENTS

| | | | |
|---|---|---|---|
| 2951069 | 7/1981 | Fed. Rep. of Germany | 400/188 |
| 49283 | 3/1983 | Japan | 400/188 |
| 66658 | 4/1986 | Japan | 400/188 |
| 116557 | 6/1986 | Japan | 400/188 |
| 192572 | 8/1986 | Japan | 400/188 |
| 202853 | 9/1986 | Japan | 400/188 |
| 274945 | 12/1986 | Japan | 400/188 |

*Primary Examiner*—E. H. Eickholt

*Attorney, Agent, or Firm*—Sperry, Zoda & Kane

[57] ABSTRACT

Apparatus for printing of mailing inserts prepackaged within envelopes and for printing of the envelopes also as desired simultaneously wherein specifically both sides of one or more inserts can be printed as desired by one pass through a computer controlled printer. Printing can be controlled for both sides of any inserts as well as the obverse or reverse surface of the front and back sheets which form the envelope. Inking means preferably in the form of carbon layers are carried at selected locations along the obverse and reverse surfaces of all inserts and each envelope sheet in such a manner as to allow impact printing on desired surfaces. The impact printer has the capability of printing both forward or conventional characters and reverse characters which are rotated about a vertically extending axis to facilitate printing on the reverse surfaces of insert sheets and envelope sheets.

24 Claims, 1 Drawing Sheet

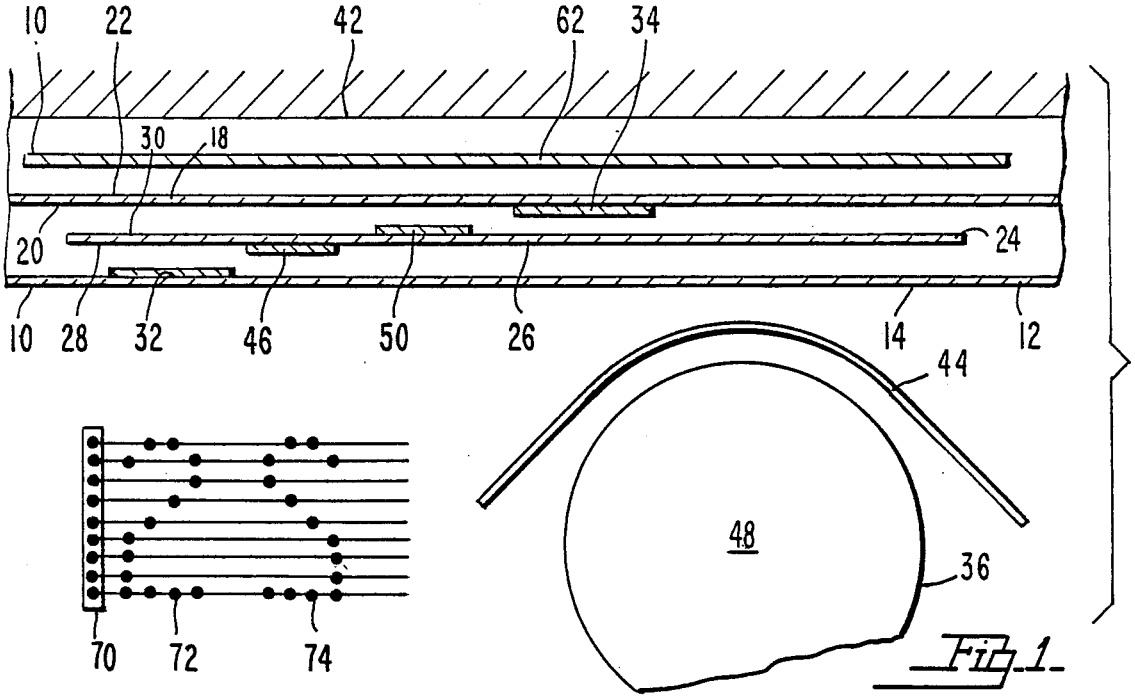
Fig. 1
Fig. 7
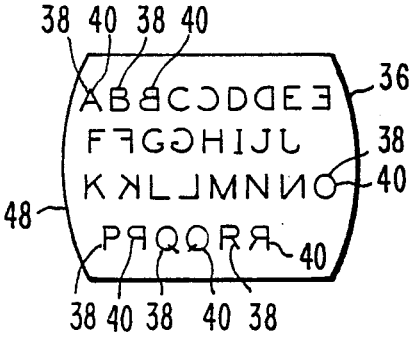
Fig. 2
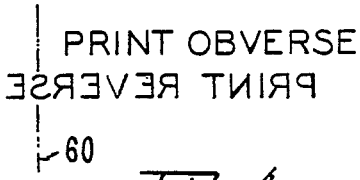
Fig. 4
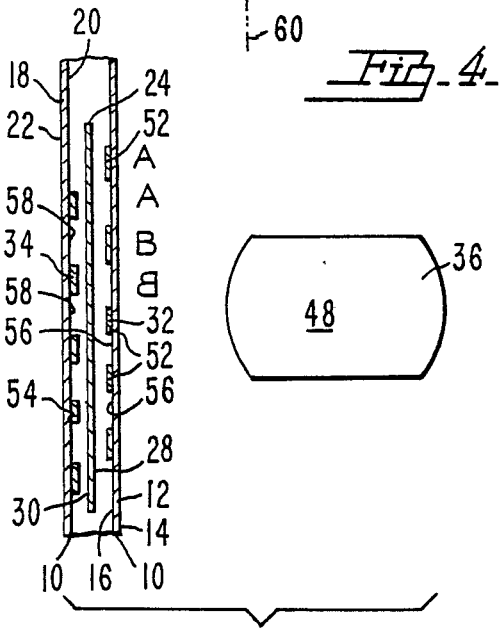
Fig. 3
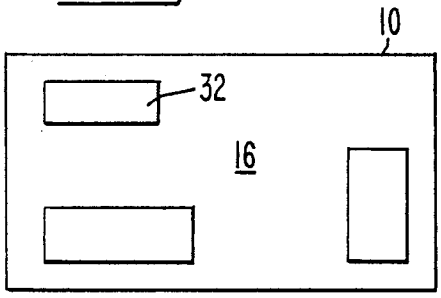
Fig. 6
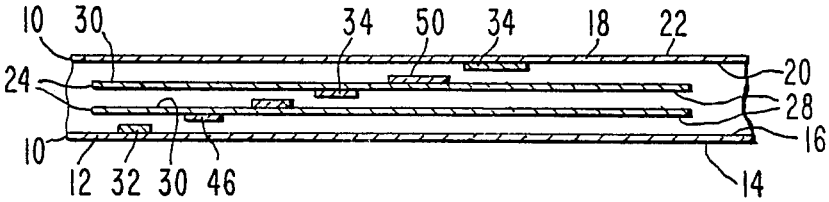
Fig. 5

APPARATUS FOR PRINTING OF ENVELOPES AND PRE-PACKAGED MAILING INSERTS LOCATED THEREIN

BACKGROUND OF THE INVENTION

1. Field of The Invention

The present invention deals with the field of printing of pre-packaged inserts and envelopes therefore. Folding and stuffing of media into envelopes is a major cost of mass mailings. Pre-packaged forms avoid the high labor cost of stuffing envelopes by providing media already positioned within the envelope and allowing impact printing which can print both the envelope and the insert simultaneously. Heretofore it has been impossible to provide a means for printing of the reverse sides of inserts within envelopes or reverse sides of front or back envelope sheets themselves.

2. Description Of The Prior Art

Designs utilized for printing of pre-packaged mailing inserts and envelopes are shown in U.S. Pats. No. 1,623,366 issued to E. E. Strawn; U.S. Pat. No. 1,653,362 issued to A. G. F. Kurowski; U.S. Pat. No. 1,930,605 issued to W. C. Bohmert; U.S. Pat. No. 2,016,599 issued to R. V. Graves; U.S. Pat. No. 2,209,586 issued to W. E. Swift, Jr.; U.S. Pat. No. 2,306,616 issued to R. J. Copeland; U.S. Pat. No. 2,858,004 issued to E. Febvre; U.S. Pat. No. 2,869,704 issued to E. H. Gates, Jr.; U.S. Pat. No. 3,104,799 issued to D. J. Steidinger; and U.S. Pat. No. 3,608,816 issued to F. H. Neubauer.

SUMMARY OF THE INVENTION

The present invention provides an apparatus for printing of envelopes and pre-packaged mailing inserts positioned therein wherein the envelope includes a front envelope sheet having an obverse front envelope surface and a reverse front envelope surface. Similarly the envelope includes a back envelope sheet which includes an obverse back envelope surface and a reverse back envelope surface.

An insert sheet means is positioned between the obverse back envelope surface of the back envelope sheet and the reverse front envelope surface of the front envelope sheet. The insert will include one or more sheets each of which will include a surface thereadjacent either an adjacent insert surface or an adjacent envelope surface to facilitate printing thereon.

First inking means preferably formed as a carbon coating is positioned selectively adjacent to the obverse insert surface for printing thereon. Preferably this first inking means includes a carbon layer mounted upon the reverse front envelope surface in selective locations thereon in those areas adjacent to areas of the obverse insert surface wherein printing is desired thereon. In a similar manner a second inking means is positioned in selective locations adjacent to the reverse insert surface for printing thereon. This second inking means preferably includes a carbon coating mounted upon the obverse back envelope surface in selective locations adjacent to areas of the reverse insert surface upon which printing is desired.

An impact printing means is included positioned adjacent to one side of the envelope and is adapted for impacting thereof for selective printing of characters upon both surfaces of each insert and upon all four surfaces associated with the front and back envelope sheets. The impact printing means preferably includes a forward character printing apparatus for imprinting of conventionally oriented print characters to facilitate printing upon the obverse front envelope surface and the obverse surface of each insert sheet. A reverse character printing means is also included within the definition of the impact printing means for printing of horizontally reverse characters to facilitate printing upon the reverse surfaces of the one or more inserts or the reverse surfaces or of the front or rear envelope sheet as desired. A platen means is included positioned adjacent to the envelope oppositely from the impact printing member to facilitate impacting of the printing means against the envelope and inserts located therein.

A third inking means may be included which may comprise a ribbon means which is positioned between the printing head and the obverse front envelope surface to facilitate printing thereon of items such as the return address and other items which are desired to appear on the obverse front envelope surface. A fourth inking means may be included adjacent to the reverse front envelope surface if it is desired to have any printing thereon. This fourth inking means preferably takes the form of a carbon coating mounted upon the obverse insert surface in selective locations adjacent to those areas of the reverse front envelope surface upon which printing is desired.

A fifth inking means may be included positioned adjacent to the obverse back envelope surface for printing as desired thereon. Preferably this fifth inking means is mounted upon the reverse insert surface in selective locations adjacent to those specific areas of the obverse back envelope surface upon which printing is desired.

A sixth inking means in the form of a carbon sheet or the like can be positioned adjacent the reverse back envelope surface for printing thereon. Preferably this sixth inking means will be positioned directly between the platen and the reverse back envelope surface adjacent those specific areas thereof upon which printing is desired.

The impact printing head can be of any variety of configurations including preferably a dot matrix printing head or alternatively a ball printing element, a daisy wheel printing element. Any other impact printing means can also be utilized for this purpose.

The insert means can comprise a plurality of individual insert sheets of one or more wherein each insert sheet includes a first inking sheet adjacent to the obverse insert surface thereof and a second inking sheet adjacent to the reverse insert surface thereof for printing thereon. These inking sheets can be carried by the adjacent surface of adjacent inserts.

The first inking means can comprise a plurality of horizontally extending first inking strips as well as a plurality of horizontally extending first intervening blank strips therebetween. Preferably the vertical dimension of the first inking strip and the first intervening blank strips will be equal. In a similar manner the second inking means can comprise a plurality of horizontally extending second inking strips and a plurality of horizontally extending second intervening blank strips therebetween also having equal vertical dimensions. The first inking strips will be horizontally registered with respect to the second intervening blank strips and the second inking strips will be horizontally oriented with respect to the first intervening blank strips in such a manner that imprinting by the impact printing head can be used to print both the obverse and reverse sides of the specific insert sheet within the given area with lines of printing more closely packed than conventional double spacing.

It is an object of the present invention to provide an apparatus for printing of envelopes and pre-packaged mailing inserts located therein wherein both sides of the pre-packaged inserts can be printed during one pass through an impact printer.

It is an object of the present invention to provide an apparatus for printing of envelopes and pre-packaged mailing inserts located therein wherein the capability exists to print upon both sides of multiple inserts as desired.

It is an object of the present invention to provide an apparatus for printing of envelopes and pre-packaged mailing inserts located therein wherein the capability exists to print both sides of the front or back envelope sheet as desired.

It is an object of the present invention to provide an apparatus for printing of envelopes and pre-packaged mailing inserts located therein wherein labor costs are greatly minimized in such printing.

It is an object of the present invention to provide an apparatus for printing of envelopes and pre-packaged mailing inserts located therein wherein the requirement for stuffing is eliminated on inserts having printing on both sides.

It is an object of the present invention to provide an apparatus for printing of envelopes and pre-packaged mailing inserts located therein wherein efficiency of processing is maximized.

It is an object of the present invention to provide an apparatus for printing of envelopes and pre-packaged mailing inserts located therein wherein maintenance costs are minimized.

It is an object of the present invention to provide an apparatus for printing of envelopes and pre-packaged mailing inserts located therein wherein the high cost of carbon sheets is minimized.

It is an object of the present invention to provide an apparatus for printing of envelopes and pre-packaged mailing inserts located therein wherein a single impact printing head can be used to print both forward characters upon all obverse surfaces of insert sheets and envelope sheets and wherein reverse characters are printed upon all reverse surfaces of insert sheets and envelope sheets.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is a top cross-sectional view of an embodiment of the pre-packaged mailing insert and envelope combination shown positioned adjacent to a printing head;

FIG. 2 is a front plan view of a ball printing head;

FIG. 3 is a front cross-sectional view of a printing head and insert sheet and envelope combination showing the inking means as horizontally extending strips having intervening blank strips therebetween;

FIG. 4 illustrates forward and reverse print characters;

FIG. 5 is a cross-section of a mailing envelope and pre-packaged mailing insert showing usage of multiple inserts;

FIG. 6 is a back plan view of an embodiment of a front envelope sheet showing selective carbon positioning thereon; and FIG. 7 is a front view of a 9×1 dot matrix print head showing a forward and a reverse "2" character.

DETAILED DESCRIPTION OF THE PREFERRED EMBODIMENT

The present invention provides an envelope means 10 which includes a front envelope sheet 12 having an obverse front envelope surface 14 and a reverse front envelope surface 16. Envelope 10 further includes a back envelope sheet 18 which includes an obverse back envelope surface 20 and a reverse back envelope surface 22.

An insert means 24 is adapted to include at least one insert sheet 26 having both an obverse insert surface 28 and a reverse insert surface 30. Insert 24 is preferably pre-packaged within envelope 10 between the front envelope sheet 12 and the back envelope sheet 18.

To facilitate printing of the insert a first inking means 32 may be included such as a carbon coating mounted upon the reverse front envelope surface in those selected areas adjacent to the obverse insert surface 28 to achieve printing thereon whenever the impact printing means 36 contacts the envelope 10. In a similar manner a second inking means 34 is adapted to print upon the reverse insert surface 30. Preferably the second inking means comprises a carbon coating mounted upon the obverse back envelope surface 20 in those selective locations adjacent to the reverse insert surface 30 upon which printing is desired.

Impact printing means 36 preferably includes both a forward character printing means 38 and a reverse character printing means 40. Reverse characters 40 preferably comprise characters identical to those characters shown in 38 which are rotated about a vertical axis 60 as shown in FIG. 4. Some characters such as "I", "O" and "T" will be the same both in the forward and reverse character mode. Alternatively however, some characters will be horizontally reversed when shown in the forward character printing mode 38 as opposed to the reverse character printing mode 40. Such characters which will reverse as shown in FIG. 4 are for example "S", "R" and "E".

A platen means 42 which may take the form of any conventional type platen is positioned behind the reverse back envelope surface 22 of back envelope sheet 18 to facilitate impacting of the impact printing means 36 against inking surfaces located in the composition of the envelope and inserts.

A third inking means 44 may be included for printing on the obverse front envelope surface. Third inking means 44 can take the form of a conventional ribbon means as shown in FIG. 1 positioned between the impact printing head and the front envelope surface. The third inking means 44 will normally be utilized for all printing which is desired to be performed upon the obverse front envelope surface.

A fourth inking means 46 may be included for printing upon the reverse front envelope surface as desired. Normally such printing is not desired but in specific applications such printing is achievable. The fourth inking means preferably comprises a carbon coating which can be mounted on the obverse insert surface in those selected areas adjacent to the reverse front envelope surface upon where printing is desired.

The printing head 48 must be an impact type printing head and can comprise any of the conventional printing heads such as a daisy wheel, a ball printing head or dot matrix printer.

A fifth inking means 50 can be included for printing on the obverse back envelope surface if desired. Normally such printing is not required. However if that capability is desired it is possible with the apparatus of the present invention by providing a carbon coating on the reverse insert surface on those selected areas adjacent to the obverse back envelope surface upon which printing is desired.

A sixth inking means 62 may be included adjacent the reverse back envelope surface. This sixth inking means can take the form of a conventional piece of carbon paper or any other carbon type sheet which can print return address or any other information which may be desired to be located upon the outside of the back envelope surface. Such a carbon sheet would normally be located directly between the platen 42 and the reverse back envelope surface 22.

If printing is desired within a specific area both on the reverse and obverse side of the insert such printing is possible by the formation of the first inking means into a plurality of horizontally extending first inking strips 52. Horizontal first inking strips 52 will be separated by horizontally extending first intervening blank strips 56 therebetween. In a similar manner the horizontal second inking strips 54 will have horizontally extending second intervening blank strips 58 therebetween.

The vertical dimension of the inking strips and the intervening strips will preferably be identical such that the impact printing head can be used to print upon one side of the insert surface while not destructing the printing on the opposite side. As the printing head passes along the horizontal first inking strip 52 printing will occur upon the obverse insert surface 28. While printing along the horizontal first inking strip 52 the printer will be traveling upon the horizontally registered horizontal second intervening blank strip 58 which is adjacent to the reverse insert surface 30. As such no printing will occur on the reverse insert surface 30. Once printing upon this line is completed the printer will drop down to print along the horizontal second inking strip 54 which is horizontally registered with respect to the horizontal first intervening blank strip 56. As such printing will then occur upon the reverse insert surface 30 and no printing will occur upon the obverse insert surface 28. The vertical spacing between these lines of printing will be less than the normal spacing between lines of a printer in such a manner as to pack the printing as densely as possible and yet not have stray characters or marks be printed upon the insert surface wherein no printing is desired. This alternating strip printing is shown best in FIG. 3 wherein the print head will contact to print the upper "A" against the obverse insert surface 28 and thereafter will drop to print the lower "A" which will only print as a stencil against the obverse insert surface 28 but which will print as a printed letter on the reverse insert surface 30. Since the letter "A" has horizontal symmetry there is no difference between the forward and the reverse print characters thereof. The upper "B" will print upon the obverse insert surface 28 and the lower "ꝑ" will be oriented with the second inking strip 54 and will thereby print upon the reverse insert surface 30. The letter "B" does not have horizontal symmetry and as such a reverse character is utilized whenever printing on the reverse side. Thus we see that all printing which will occur upon obverse surfaces of the one or more inserts or upon the obverse surfaces of the one or more inserts or upon the obverse front envelope surface 14 or the obverse back envelope surface 20 will utilize the forward character printing means 38. On the other hand all characters which will be printed upon the reverse insert surfaces 30 or the reverse front envelope surface 16 or the reverse back envelope surface 22 will require the reverse characters 40 to be printed. Also the print will be in an opposite direction as shown in the lower portion of FIG. 4.

In actual working operation the print head 48 will usually be operated by a computer means such that printing on both sides of for example the insert sheet 26 can be performed in one downward sweep of the print head. This is achieved with the carbon configuration shown in FIG. 3 by having one software file containing the data for printing on the obverse side and for having a second file for retaining the information which should be printed on the reverse side. As an example in the first horizontal pass using the carboning configuration shown in FIG. 3 the computer controlled printer will print as much information from the first file as possible on the obverse side of the insert. In the next pass immediately therebelow which causes printing on the reverse side of the insert the first line of information will be withdrawn from the second file. On the third horizontal pass by the printer head the computer software will return to the first file and will print the next segment of information capable of being printed on the second line of the obverse side. Similarly the second line of the reverse side will receive the next line of material from the second file. In this manner only one pass vertically is required in order to print entire messages on both the reverse and obverse side of an insert or other printing target by utilizing the carboning configuration shown in FIG. 3. Also there will be no printing on the reverse side when the obverse side is printed due to the first intervening blank strip 56. In a similar manner there will be no printing on the obverse side when the reverse side is printing due to the positioning of the second intervening blank strips 58.

Whenever multiple insert sheets 26 are included the first inking means 32 and second inking means 34 must be positioned adjacent to the obverse insert surface 28 and the reverse insert surface 30, respectively. These inking means 32 and 34 can take the form of carbon sheets or a carbon coating on the adjacent surface. Regardless of the particular configuration every obverse insert surface 28 must include a first inking means 32 positioned in abutment therewith and every reverse insert surface 30 must include a second inking means 34 in abutment therewith. Preferably these will take the form of carbon coatings mounted on adjacent surfaces.

FIG. 7 schematically illustrates a dot matrix print head 70 with a 9×1 pin configuration. The printed numeral 72 shows a forward printed "2". The printed numeral 74 shows a reverse printed "2". Each of these is usable for printing on either the obverse or reverse side of any portion of the envelope 10 or insert 24.

Preferably the print head 48 will include a fontive type with a minimum number of characters including ascending or descending portions thereof. For example letters which include descending portions are "p", "y" and "g". Examples of characters with ascending portions include "h", "k" and "f". By minimizing the letters having ascending and descending portions the possibility for extraneous printing when utilizing the alternating strips shown in FIG. 3 will be minimized.

Certain types of paper are designed to provide copies on multiple sheets without requiring a specific carbon sheet being placed therein. Such papers have been commonly known heretofore as "NCR Paper". These papers utilize a chemical layer on the surface of the sheet to be copied and another different chemical formed as a layer on a sheet positioned thereadjacent. As pressure is placed upon the top sheet the sheets therebelow will be marked upon by mixing of the two different layers of chemicals. This two chemical layer configuration is contemplated within the purview of the present invention as comprising an inking means positioned "adjacent" to the insert surface for printing thereon.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. Apparatus for printing of envelopes and pre-packaged mailing inserts located therein which comprises:

(a) an envelope means including:
  (1) a front envelope sheet which further includes;
    (a) an obverse front envelope surface;
    (b) a reverse front envelope surface;
  (2) a back envelope sheet which further includes;
    (a) an obverse back envelope surface;
    (b) a reverse back envelope surface;

(b) an insert means positioned between said obverse back envelope surface of said back envelope sheet and said reverse front envelope surface of said front envelope sheet, said insert means including at least one insert sheet, each said insert sheet including an obverse insert surface and a reverse insert surface;

(c) a first inking means positioned selectively adjacent said obverse insert surface for printing thereon;

(d) a second inking means positioned selectively adjacent said reverse insert surface for printing thereon;

(e) an impact printing means positioned adjacent to one side of said envelope means and adapted to impact same for selective printing of said obverse insert surface, said reverse insert surface and said obverse front envelope surface, said impact printing means including;
  (1) a forward character printing means for imprinting of conventionally oriented print characters to facilitate printing of said obverse front envelope surface and said obverse insert surface;
  (2) a reverse character printing means for imprinting of horizontally reversed characters to facilitate printing of said reverse insert surface; and (f) a platen means positioned adjacent said envelope oppositely from said impact printing means to facilitate impacting of said impact printing means against said envelope means.

2. Apparatus for printing of envelopes and pre-packaged mailing inserts located therein as defined in claim 1 wherein said first inking means comprises a carbon coating.

3. Apparatus for printing of envelopes and pre-packaged mailing inserts located therein as defined in claim 1 wherein said second inking means comprises a carbon coating.

4. Apparatus for printing of envelopes and pre-packaged mailing inserts located therein as defined in claim 1 further comprising a third inking means positioned adjacent said front envelope sheet for printing upon said obverse front envelope surface.

5. Apparatus for printing of envelopes and pre-packaged mailing inserts located therein as defined in claim 4 wherein said third inking means comprises a ribbon means.

6. Apparatus for printing of envelopes and pre-packaged mailing inserts located therein as defined in claim 4 further comprising a fourth inking means positioned adjacent said reverse front envelope surface for printing thereon.

7. Apparatus for printing of envelopes and pre-packaged mailing inserts located therein as defined in claim 6 wherein said fourth inking means is mounted upon said obverse insert surface.

8. Apparatus for printing of envelopes and pre-packaged mailing inserts located therein as defined in claim 6 wherein said fourth inking means comprises a carbon coating.

9. Apparatus for printing of envelopes and pre-packaged mailing inserts located therein as defined in claim 6 further comprising a fifth inking means positioned adjacent said obverse back envelope surface for printing thereon.

10. Apparatus for printing of envelopes and pre-packaged mailing inserts located therein as defined in claim 9 wherein said fifth inking means is mounted upon said reverse insert surface.

11. Apparatus for printing of envelopes and pre-packaged mailing inserts located therein as defined in claim 9 wherein said fifth inking means comprises a carbon coating.

12. Apparatus for printing of envelopes and pre-packaged mailing inserts located therein as defined in claim 1 wherein said first inking means is mounted upon said reverse front envelope surface.

13. Apparatus for printing of envelopes and pre-packaged mailing inserts located therein as defined in claim 1 wherein said second inking means is mounted upon said obverse back envelope surface.

14. Apparatus for printing of envelopes and pre-packaged mailing inserts located therein as defined in claim 9 further including a sixth inking means positioned adjacent said reverse back envelope surface for printing thereon.

15. Apparatus for printing of envelopes and pre-packaged mailing inserts located therein as defined in claim 1 where said impact printing means includes a ball printing element.

16. Apparatus for printing of envelopes and pre-packaged mailing inserts located therein as defined in claim 1 wherein said impact printing means includes a daisy wheel printing element.

17. Apparatus for printing of envelopes and pre-packaged mailing inserts located therein as defined in claim 1 wherein said impact printing means includes a dot matrix printing head.

18. Apparatus for printing of envelopes and pre-packaged mailing inserts located therein as defined in claim 1 wherein said insert means includes a plurality of said insert sheets.

19. Apparatus for printing of envelopes and pre-packaged mailing inserts located therein as defined in claim 18 wherein said first inking means includes a plurality of first inking sheets with each being positioned adjacent to each of said obverse insert surfaces of the plurality of said insert sheets for imprinting thereon.

20. Apparatus for printing of envelopes and pre-packaged mailing inserts located therein as defined in claim 18 wherein said second inking means includes a plurality of second inking sheets with each being positioned adjacent to each of said reverse insert surfaces of the plurality of said insert sheets for imprinting thereon.

21. Apparatus for printing of envelopes and pre-packaged mailing inserts located therein as defined in claim 1 wherein said first inking means includes a plurality of horizontally first inking strips and a plurality of horizontally extending first intervening blank strips therebetween.

22. Apparatus for printing of envelopes and pre-packaged mailing inserts located therein as defined in claim 21 wherein said second inking means includes a plurality of horizontally second inking strips and a plurality of horizontally extending second intervening blank strips therebetween.

23. Apparatus for printing of envelopes and pre-packaged mailing inserts located therein as defined in claim 22 wherein said first inking strips are in horizontal registration with respect to said second intervening blank strips and wherein said second inking strips are in horizontal registration with respect to said first intervening blank strips.

24. Apparatus for printing of envelopes and pre-packaged mailing inserts located therein which comprises:

(a) an envelope means including;
  (1) a front envelope sheet which further includes;
    (a) an obverse front envelope surface;
    (b) a reverse front envelope surface;
  (2) a back envelope sheet which further includes;
    (a) an obverse back envelope surface;
    (b) a reverse back envelope surface;

(b) an insert means positioned between said obverse back envelope surface of said back envelope sheet and said reverse front envelope surface of said front envelope sheet, said insert means including at least one insert sheet, each said insert sheet including an obverse insert surface and a reverse insert surface;

(c) a first inking means positioned selectively adjacent said obverse insert surface for printing thereon, said first inking means comprising a carbon coating mounted upon said reverse front envelope surface;

(d) a second inking means positioned selectively adjacent said reverse insert surface for printing thereon, said second inking means comprising a carbon coating mounted upon said obverse back envelope surface;

(e) an impact printing means positioned adjacent to one side of said envelope means and adapted to impact same for selective printing of said obverse insert surface, said reverse insert surface and said obverse front envelope surface, said impact printing means including;
  (1) a forward character printing means for imprinting of conventionally oriented print characters to facilitate printing of said obverse front envelope surface and said obverse insert surface;
  (2) a reverse character printing means for imprinting of horizontally reversed characters to facilitate printing of said reverse insert surface;

(f) a third inking means comprising a ribbon means positioned adjacent said front envelope sheet for printing upon said obverse front envelope sheet;

(g) a fourth inking means comprising a carbon coating mounted on said obverse insert surface to be positioned adjacent said reverse front envelope surface for printing thereon;

(h) a fifth inking means comprising a carbon coating mounted on said reverse insert surface to be positioned adjacent said obverse back envelope surface for printing thereon;

(i) a platen means positioned adjacent said envelope oppositely from said impact printing means to facilitate impacting of said impact printing means against said envelope means; and (j) sixth inking means positioned between said back envelope sheet and said platen means for imprinting upon said reverse back envelope surface.

* * * * *